United States Patent [19]

Mowatt-Larssen

[11] Patent Number: 4,711,274

[45] Date of Patent: Dec. 8, 1987

[54] EXTERNAL PURGE SYSTEM FOR A TANK TRAIN

[75] Inventor: Erling Mowatt-Larssen, Valparaiso, Ind.

[73] Assignee: General American Transportation Corporation, Chicago, Ill.

[21] Appl. No.: 31,181

[22] Filed: Mar. 26, 1987

Related U.S. Application Data

[63] Continuation of Ser. No. 851,868, Apr. 11, 1986, abandoned, which is a continuation of Ser. No. 631,080, Jul. 16, 1984, abandoned.

[51] Int. Cl.[4] ..... B65B 1/04

[52] U.S. Cl. ..... 141/5; 141/35

[58] Field of Search ..... 141/5, 35

[56] References Cited

U.S. PATENT DOCUMENTS

| | | | |
|---|---|---|---|
| Re. 23,543 | 9/1952 | Duncan | 141/35 X |
| Re. 26,529 | 3/1969 | Lichtenberger et al. | 141/5 |
| 2,603,396 | 7/1952 | Redin et al. | 141/35 X |
| 2,645,907 | 7/1953 | Droste et al. | 141/3 X |
| 2,668,001 | 2/1954 | Harstick | 141/35 |
| 2,670,889 | 3/1954 | Heckendorf | 141/35 |
| 2,680,553 | 6/1954 | Hein | 141/35 |
| 2,708,542 | 5/1955 | Gray et al. | 141/7 |
| 3,241,580 | 3/1966 | Lichtenberger et al. | 141/5 |
| 3,318,345 | 5/1967 | Beall, Jr. | 141/59 |
| 3,675,670 | 7/1972 | Ogawa | 141/35 X |
| 3,863,664 | 2/1975 | Holbrook et al. | 141/35 X |
| 3,897,807 | 8/1975 | Hurst et al. | 141/98 |
| 3,989,059 | 11/1976 | Price et al. | 137/347 |
| 4,002,192 | 1/1977 | Mowatt-Larssen | 141/35 |
| 4,007,764 | 2/1977 | Bandemor | 141/35 |
| 4,007,765 | 2/1977 | Hurst | 141/59 |
| 4,008,739 | 2/1977 | Hurst et al. | 141/35 |
| 4,079,760 | 3/1978 | Hurst | 141/35 |
| 4,181,121 | 1/1980 | Schwoboda et al. | 141/35 X |
| 4,258,758 | 3/1981 | Nygards | 141/35 |
| 4,304,271 | 12/1981 | Mowatt-Larssen | 141/35 |
| 4,586,547 | 5/1986 | Fields et al. | 141/35 |

*Primary Examiner*—Henry J. Recla
*Assistant Examiner*—Mark J. Thronson
*Attorney, Agent, or Firm*—Hill, Van Santen, Steadman & Simpson

[57] ABSTRACT

A novel purge system for a string of tank cars wherein purge gas is directly introduced into the vapor space of each tank above the cargo in the tank and wherein the purge gas is not bubbled through the cargo but is supplied directly to the vapor space above the cargo and forces the cargo out the vent pipe at the end of the car to the next car to successively assure that the proper level of cargo and the proper pressure of the purge gas is maintained in all of the cars. Since the gas is not bubbled through the cargo, gas will not be stored in the cargo and the pressure requirements will be substantially reduced as compared to bubbling through the commodity and the volume of gas required will be reduced due to the lower pressure and elimination of potential absorption which may occur when the bubbling method is utilized.

2 Claims, 3 Drawing Figures

EXTERNAL PURGE SYSTEM FOR A TANK TRAIN

This is a continuation of application Ser. No. 851,868, filed Apr. 11, 1986, now abandoned, which was a continuation of application Ser. No. 631,080, filed July 16, 1984, now abandoned.

BACKGROUND OF THE INVENTION

1. Field of the Invention

This invention relates in general to method and apparatus for purging a string of railway cars by introducing purge gas directly to the vapor space of each car.

2. Description of the Prior Art

In prior art, loading and unloading systems for tank car and trains, the purge gas has been introduced into the cargo near the bottom of the tank which causes it to bubble up through the cargo and also to be absorbed in the cargo. U.S. Pat. Nos. 3,897,807 and 4,304,271 assigned to the assignee of the present invention disclose such prior art systems.

Such prior art systems introduce the purge gas in the induction pipe which terminates near the bottom of the tank and, thus, the purge gas passes up through the cargo or commodity before reaching the vent space and forcing the cargo out the vent pipe at the other end of the car. Also, as the purge gas passes from the end of the first car through the vent it passes into the eduction pipe of the second car and is ejected near the bottom of the tank from the eduction pipe of the second car where it passes again up through the commodity to the vent space and so on. Such prior art systems require high pressure requirements for the purge gas since the gas must be forced up through the commodity. Also, a substantial volume of gas is absorbed in the commodity.

SUMMARY OF THE INVENTION

The present invention purging of a string of cars occurs by introducing the purge gas directly to the vapor space of each tank rather than through the eduction pipe.

All fittings for operating the valves are mounted externally of the tank and can be inspected and maintained and repaired without personnel entering the tank interior. It is to be realized that if a man must enter the interior of a tank, the tank must be cleaned and the atmosphere must be controlled which substantially adds to the cost of maintenance and repairs of the equipment. In the present invention, external fittings result in a more economical and practical operation design as compared to the prior art system which utilizes internal fittings.

In the present system, the purge gas is directly introduced into the vapor space above the commodity and the pressure requirements are reduced by a factor generally in the order of five compared to bubbling the gas through the commodity and the volume of gas required is also reduced because of the lower pressure that can be used and the elimination of the potential absorption which occurs with the bubbling gas method.

Because of the lower purge gas pressure requirements, longer strings of cars can be used in a train and this is important where the pressure is the controlling factor of the length of the train.

The advantages of the present invention are that it is cheaper in that less gas is used and a potential longer string car lengths can be obtained and saving in the purging time occurs and also the elimination of product contamination by the purge gas is eliminated.

The non-bubbling external purge system of the invention results in a substantial improvement over systems of the prior art.

Other objects, features and advantages of the invention will become apparent from the following description and claims when read in view of the drawings in which:

DESCRIPTION OF THE PREFERRED EMBODIMENTS

Figure 1:
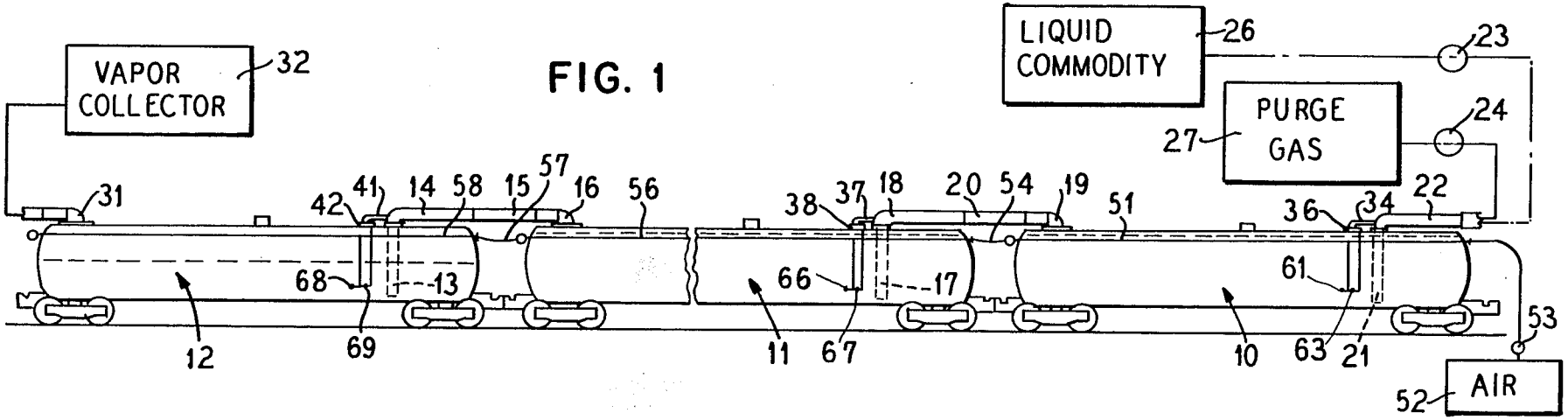
FIG. 1 is a side plan view of a string of tank cars in which the invention is installed.

FIG. 1 illustrates a series of tank cars 10, 11 and 12 which represent a number of tank cars connected together and interconnected by flexible hoses. For example, the last car 12 has an eduction pipe 13 in one end thereof which terminates adjacent the bottom of the tank car and its upper end is connected to a horizontal portion 14 which connects to the upper portion 16 of a vent pipe for a car 11. The car 11 has an eduction pipe 17 which is connected to a portion 18 outside of the tank which connects to a vent pipe 19 of car 10. The supporting structure for the flexible pipe 15 and 20 between the cars 11 and 12 and 10 and 11 respectively, is supported as described in U.S. Pat. No. 4,304,271 for example.

The eduction pipe 21 of car 10 has a horizontal portion 22 external of the tank and is selectively connected through valves 23 and 24 to the liquid commodity 26 which is to be stored in the tanks or to the purge gas supply 27. The vent pipe 31 of the last car 12 in the string may be connected to a vapor collector 32 for example.

Figure 2:
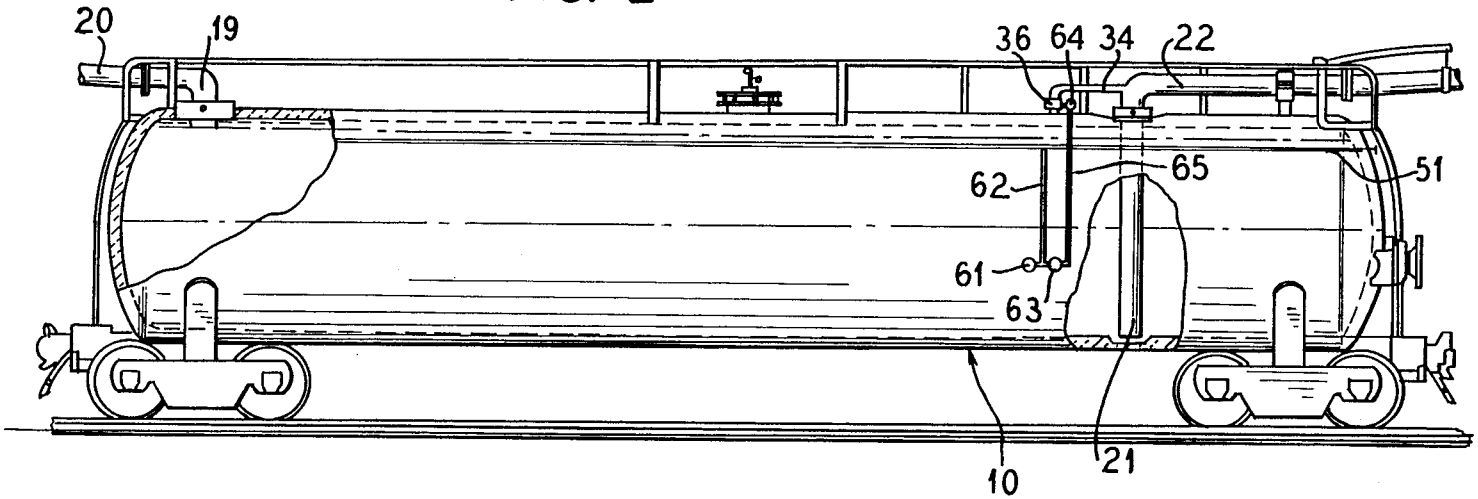
FIG. 2 is a side plan view partially cut-away illustrating the invention.

Connected to each of the eduction pipes of each of the cars 10, 11 and 12 is a conduit which passes through a valve and then connects to the top of the tank. For example, car 10 illustrated in detail in FIG. 2 has a pipe 34 which fluidly connects to the horizontal portion 22 of eduction pipe 21 and passes through a valve 36 and opens into the top of the tank 10. Thus, when valve 36 is open, purge gas can pass through the conduit 22 into the conduit 34 and through valve 36 into the top of tank 10. During normal loading, the valve 36 is closed so the liquid commodity from reservoir 26 passes through valve 23, conduit 22 and through the eduction pipe 21 and is discharged adjacent the bottom of the tank 10. When the tank has been filled to the lower end of vent conduit 19, the liquid commodity passes into the vent pipe 19 and through the flexible conduit 20 into the horizontal portion 18 of the eduction pipe 17 and to the bottom of tank 11. The conduit 18 has a pipe 37 fluidly connected thereto which passes through a valve 38 and has an outlet at the top of the tank 11. Normally, the valve 38 is closed and the commodity from conduit 18 passes through eduction pipe 17 to bottom of tank 11 and fills the tank 11 until it reaches the bottom of the vent 16 and passes through vent 16, flexible conduit 15, pipe 14 and eduction pipe 13 into tank 12. A pipe 41 is fluidly connected to the pipe 14 and terminates in a valve 42 which has an outlet into the top of tank 12. The valve 42 is normally closed so the fluid commodity passes through eduction pipe 14 and 13 to the bottom of tank 12 to fill the tank 12 to the desired level.

An airline 51 is connected to a suitable air supply 52 through a valve 53. The airline 51 passes through a connecting airline 54 to an airline 56 which extends the length of car 11 and through a flexible connecting airline 57 to an airline 58 which extends the length of car 12. The airlines 51, 56 and 58 are utilized to operate the valves 36, 38 and 42 during purging. In other words, the valves 36, 38 and 42 are normally closed when the liquid commodity is being supplied to the tank cars 10, 11 and 12 but when purging will occur the valves 36, 38 and 42 are opened by supplying air through the valve 53 to open the valves 36, 38 and 42. As shown in detail in FIGS. 2 and 3, each of the cars have first air valves 61 which are connected to the airline 51 by an airline 62. With valve 61 closed and with air pressure in airline 51, the air passes through the line 62 through a second valve 63, line 65 to a pneumatic actuating member 64 of valve 36 to open it. Thus, when air pressure is applied to line 51 and with valve 61 closed and valve 63 open, the butterfly valve actuator 64 opens valve 36. Each of the valves 38 and 42 are also actuated by a pair of valves such as valves 61 and 63. For example, valve 38 is actuated by valves 66 and 67 and valve 42 is actuated by valves 68 and 69.

In operation, the tanks 10, 11 and 12 are filled from the liquid commodity 26 by opening valve 23 and after tank 10 is filled the commodity passes up through vent pipe 19, flexible pipe 20 and eduction pipes 18, 17 to fill tank 11 and after tank 12 is filled through vent pipe 16 flexible pipe 15 and pipes 14 and 13 to fill tank 12. Then the valve 23 is closed and valve 53 is opened to pressurize lines 51, 56 and 58 to activate opening of valves 36, 38 and 42. Then the purge gas is supplied through valve 24 and pipe 34 and valve 36 into the top of the tank 10. When the vapor space in car 10 is pressurized, the liquid level in car 10 which may be above the bottom of the lower end of vent pipe 19 will be lowered to the level of the bottom of the vent pipe 19 and then the gas will pass through vent 19, conduits 20 and 18, 37 and valve 38 into the vent space of car 11 where it will reduce the liquid level to the bottom of vent pipe 16 after which the purge gas will pass through vent 16, conduits 15, 14, 41 and valve 42 into the vent space of car 12. The process, of course, is continued through a string of cars until all of the cars have been purged. The last car in the string when being loading such as car 12 in the illustrated example of FIG. 1 is not filled completely so that the excess liquid commodity can flow from the preceding cars into it.

After all the purging has been completed, valve 24 is closed and air valve 53 is closed and valves 61, 66 and 68 are opened at this time.

It is to be realized that a large string of tank cars can be loaded in this fashion even if only three are illustrated in this example.

Figure 3:
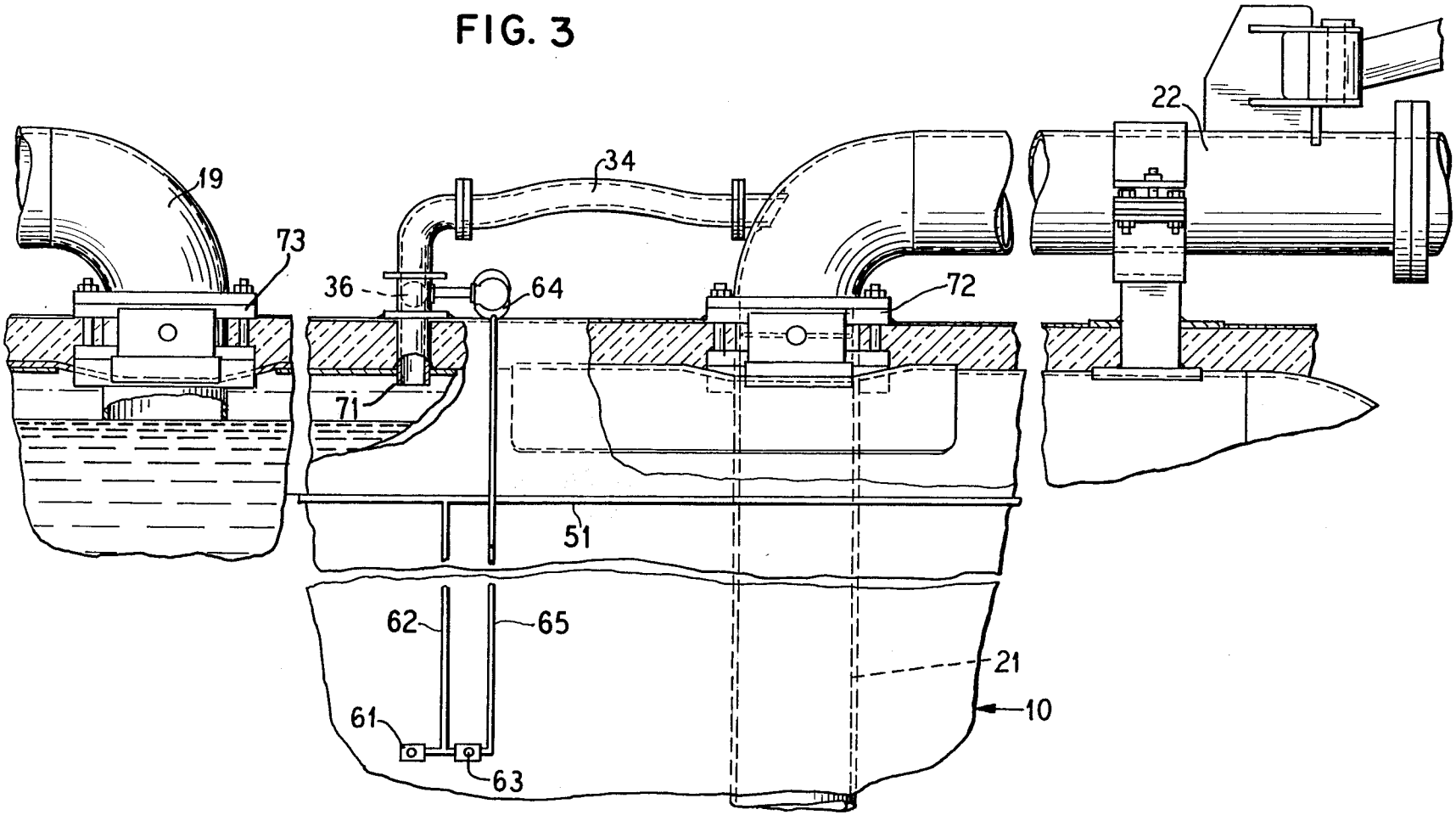
FIG. 3 is an enlarged detail cut-away view illustrating the invention.

As shown in FIG. 3 a portion of pipe 71 extends into the top of tank 10. FIG. 3 also shows the fitting 72 and 73 for pipes 21 and 19.

A second and optional arrangement of this invention is to use a one-way or spring loaded check valve in lieu of pneumatic activated valves 36, 38 and 42. For certain commodities loading thru both the eduction pipes 13, 17 and 21 and through conduits 4, 37 and 34 are permissible. In such a case a less costly system with pressure (commodity or gas) activated check valves can be used with check valves in conduits 34, 37 and 41. Air source 52, valve 53 and lines 51, 56 and 58 are not required.

It is to be realized that the valves 61, 63, 66, 67, 68 and 69 are manually operated by the loading rack operator who must walk from one end of the train to the other to inspect the train anyway. For example, if the train has been loaded and purging is to be done, he will close valve 61 and open valve 63 and the equivalent valves on all cars. Then valve 53 will be opened to supply air pressure to all the cars which will actuate valve actuator 64 which opens valve 36. All equivalent valves in the other cars will also be opened.

After purging the air supply valve is closed and then the operator manually opens valve 61 to dump the air from the line and then closes valve 63. Valve 36 is closed when the air is dumped.

For certain flammable liquids a materials valve 36 must be closed when loading the cars, however, for other materials the valve 36 could remain open during loading. The operator positively opens the valves at the top of the cars.

It is seen that this invention provides a new and novel filling and purging system for tank cars and although it has been described with respect to preferred embodiments, it is not to be so limited as changes and modifications may be made therein which are within the full intended scope of the invention as defined by the appended claims.

I claim as my invention:

1. A method of filling and purging a string of tank cars which are interconnected by conduits comprising the steps of, supplying lading into the bottom of a first tank car at a first end of said first tank car to fill said first tank car through a first conduit, supplying lading into the bottom of a second tank car at a first end of said second tank car from the top of the second end of said first tank car through a second conduit to fill said second tank car and so on down the string of tank cars until they are all filled, opening a plurality of valves which can be positively opened and closed in said first and second conduits and which have outlets at said first ends at the top of said first and second tank cars, said valves being opened by an operator from a position remote from the valves, and supplying a purge gas at said first end into the top of said first car through said valve in said first conduit and into the first end at the top of said second tank car through said valve in said second conduit so as to purge the second conduit between the first and second tank cars and so on down the string of tank cars until all of the conduits have been purged.

2. The method of claim 1 including the additional step of closing said plurality of valves.

* * * * *